US010407788B2

(12) United States Patent
Weinhold et al.

(10) Patent No.: US 10,407,788 B2
(45) Date of Patent: Sep. 10, 2019

(54) METHOD FOR GALVANIC METAL DEPOSITION

(71) Applicant: Atotech Deutschland GmbH, Berlin (DE)

(72) Inventors: Ray Weinhold, Berlin (DE); Uwe Kirbach, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 0 days.

(21) Appl. No.: 15/756,755

(22) PCT Filed: Dec. 1, 2016

(86) PCT No.: PCT/EP2016/079395
§ 371 (c)(1),
(2) Date: Mar. 1, 2018

(87) PCT Pub. No.: WO2017/093382
PCT Pub. Date: Jun. 8, 2017

(65) Prior Publication Data

US 2018/0265999 A1 Sep. 20, 2018

(30) Foreign Application Priority Data

Dec. 3, 2015 (EP) ..... 15197885

(51) Int. Cl.
*C25D 5/08* (2006.01)
*C25D 7/12* (2006.01)
(Continued)

(52) U.S. Cl.
CPC ..... *C25D 5/08* (2013.01); *C25D 7/12* (2013.01); *C25D 17/001* (2013.01); *C25D 17/06* (2013.01)

(58) Field of Classification Search
CPC ..... C25D 5/08; C25D 5/026; C25D 7/12–126
See application file for complete search history.

(56) References Cited

U.S. PATENT DOCUMENTS 5,421,987 A 6/1995 Tzanavaras et al.
5,522,975 A 6/1996 Andricacos et al.
(Continued)

FOREIGN PATENT DOCUMENTS

EP 2813601 12/2014
JP 0261089 3/1990
(Continued)

OTHER PUBLICATIONS

PCT/EP2016/079395; PCT International Search Report and Written Opinion of the International Searching Authority dated Mar. 20, 2017.

*Primary Examiner* — Bryan D. Ripa
*Assistant Examiner* — Ho-Sung Chung
(74) *Attorney, Agent, or Firm* — Renner, Otto, Boisselle & Sklar, LLP

(57) ABSTRACT

This invention concerns a method for galvanic metal deposition of a substrate using an anode and an electrolyte, wherein from each of a plurality of electrolyte nozzles a locally confined electrolyte stream is directed towards a part of a substrate surface which is to be treated, wherein a relative movement is carried out between the substrate and the electrolyte stream during deposition, characterized in that a first movement is carried out along a first path, wherein at least along a part of the first path a second movement is carried out along a second path, wherein the first and the second movement each are relative movements between the electrolyte stream and the substrate. Further, the invention concerns a substrate holder reception apparatus and an electrochemical treatment apparatus.

14 Claims, 10 Drawing Sheets

(51) Int. Cl.
*C25D 17/00* (2006.01)
*C25D 17/06* (2006.01)

(56) References Cited

U.S. PATENT DOCUMENTS

| | | | | |
|---|---|---|---|---|
| 6,280,581 | B1 | 8/2001 | Cheng | |
| 2001/0040100 | A1* | 11/2001 | Wang | C25D 5/026 205/220 |
| 2005/0072680 | A1 | 4/2005 | De Kubber | |
| 2010/0003808 | A1* | 1/2010 | Mevellec | H01L 21/312 438/469 |
| 2010/0176004 | A1 | 7/2010 | Schneider et al. | |
| 2014/0318977 | A1* | 10/2014 | Moore | C25D 17/06 205/157 |

FOREIGN PATENT DOCUMENTS

| | | |
|---|---|---|
| JP | 2001049494 | 2/2001 |
| JP | 2008019496 | 1/2008 |
| WO | 2014095356 | 6/2014 |
| WO | 2017021489 | 2/2017 |

* cited by examiner

METHOD FOR GALVANIC METAL DEPOSITION

The present application is a U.S. National Stage Application based on and claiming benefit and priority under 35 U.S.C. § 371 of International Application No. PCT/EP2016/079395, filed 1 Dec. 2016, which in turn claims benefit of and priority to European Application No. 15197885.5 filed 3 Dec. 2015, the entirety of both of which is hereby incorporated herein by reference.

FIELD OF THE INVENTION

The present invention relates to a method for electrochemical treatment of a substrate, namely a galvanic metal deposition on a substrate. Further, the invention concerns a substrate holder reception apparatus and an electrochemical treatment apparatus.

BACKGROUND OF THE INVENTION

In many electrochemical processes, especially in galvanic metal deposition, substrates are treated by bringing metal ions to the substrate using an electrolyte stream. Typically, electrical charges are carried by ions in the electrolyte, and the substrate is electrically connected to supply the process with electrons. The chemical, hydraulic and geometrical properties of the electrolyte stream determine the amount of ions that is brought to the substrate and particularly to certain regions of the substrate. In typical processes, the intensity of the treatment is dependent on the amount of ions which reach a certain place on the substrate.

In many electrochemical processes, a homogeneous treatment is required. In order to achieve this, it is desired to bring the same amount of ions to each point of the substrate. Usually, the electrolyte is directed to a substrate using at least one nozzle through which the electrolyte passes. This leads to the higher treatment intensity at the points of the substrate to which the nozzles and thus the electrolyte stream are directed. In case of a galvanic metal deposition process, this leads to greater coating thickness at these points which renders the coating inhomogeneous. Further, the electrolyte stream is not homogeneous. Thus, also from this fact and inhomogeneity arises.

In the state of the art, often the greatest distance possible between the anode and the substrate is chosen in order to homogenize the electrolyte stream over the distance regarding concentration effects caused by at least one nozzle which directs this stream towards the substrate. This delivers usable results which, however, are improvable. To this end, in the state of the art, processes are known in which the substrate is moved relative to the nozzles which is carried out in order to homogenize the treatment of the substrate. These movements are carried out as circular movements of the whole substrate around a fixed point of the substrate.

A disadvantage of this known process is that a still quite inhomogeneous coating thickness results in the region of the fixed point around which the circular movement is carried out.

Objective of the Present Invention

In view of the prior art, it was thus an object of the present invention to provide an improved electrochemical process which produces a more homogeneous result.

SUMMARY OF THE INVENTION

Subject-matter of the invention is a method for electrochemical treatment of a substrate.

According to the invention, a first movement along a first path is carried out. This movement is carried out along the substrate surface. Additionally to the first movement, a second movement along the second path is carried out along the first path. Thus, an overall relative movement of the substrate and the electrolyte stream is carried out which is determined by a resulting path that results from a summation of the first and the second path along the substrate surface. In short, the second movement adds to the first movement to form a result movement which is relative between the electrolyte stream and the substrate surface. The first and the second movement can be carried out by separate movement units, but it is preferred to use a single movement unit which can be controlled electrically in order to add the first and the second path in the control. The summation of the first and the second movement take place geometrically, but it does not necessarily have to take place simultaneously in time, though this is also possible. The first and the second movement are relative movements between the substrate and the electrolyte stream.

An advantage of this kind of relative movement between the electrolyte stream and the substrate is that the deposition can take place in a much more distributed way which in turn leads to a better homogeneity of the thickness of the coating. This is possible if the path of the first and the second movements are carried out such that the resulting path overlaps itself, but it is also possible if the resulting path does not overlap itself because the treatment area of the locally confined electrolyte stream is wider than the theoretical resulting path along which the relative movement between the substrate holder and the electrolyte stream takes place. Thus, the treatment area can overlap without an overlapping resulting path.

BRIEF DESCRIPTION OF THE FIGURES

For a more complete understanding of the present invention, reference is made to the following Detailed Description of the Invention considered in conjunction with the accompanying figures, in which.

DETAILED DESCRIPTION OF THE INVENTION

Figure 1:
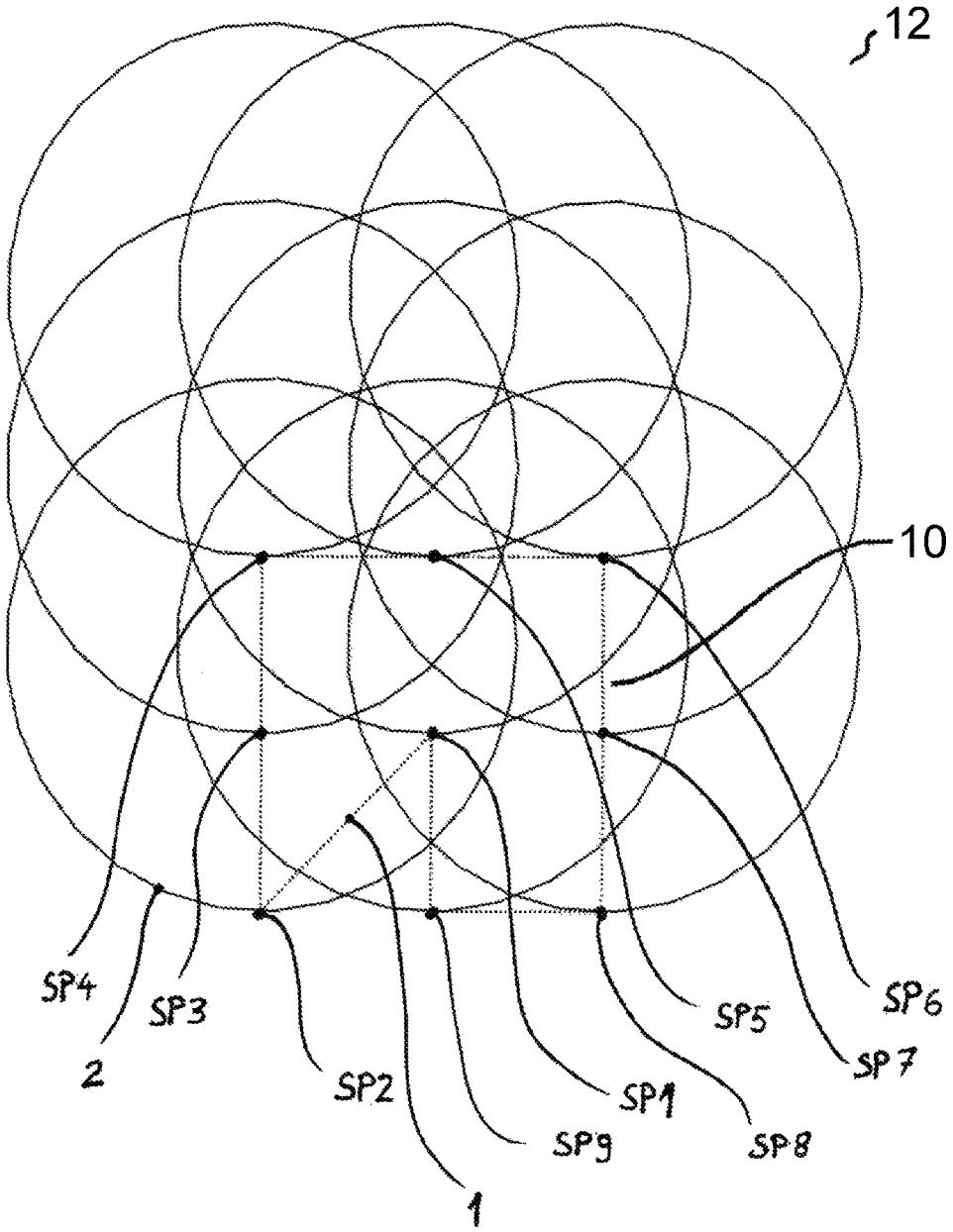
FIG. 1 shows a schematic representation of a resulting path in which a first path of first movement and a second path of a second movement is added.
Figure 2:
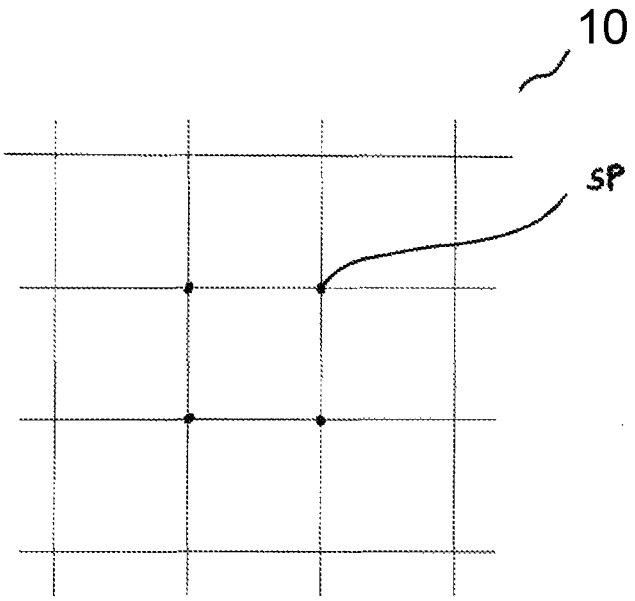
FIG. 2 shows a schematic representation of a pattern of stop points in form of an array with two rows and two columns.
Figure 3:
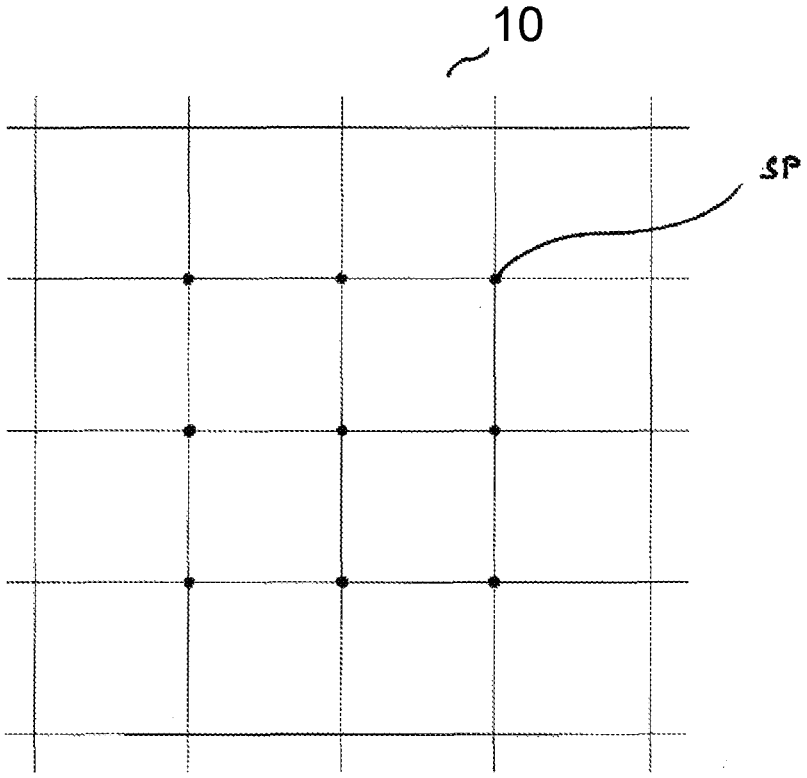
FIG. 3 shows a schematic representation of a pattern of stop points in form of an array with three rows and three columns.
Figure 4:
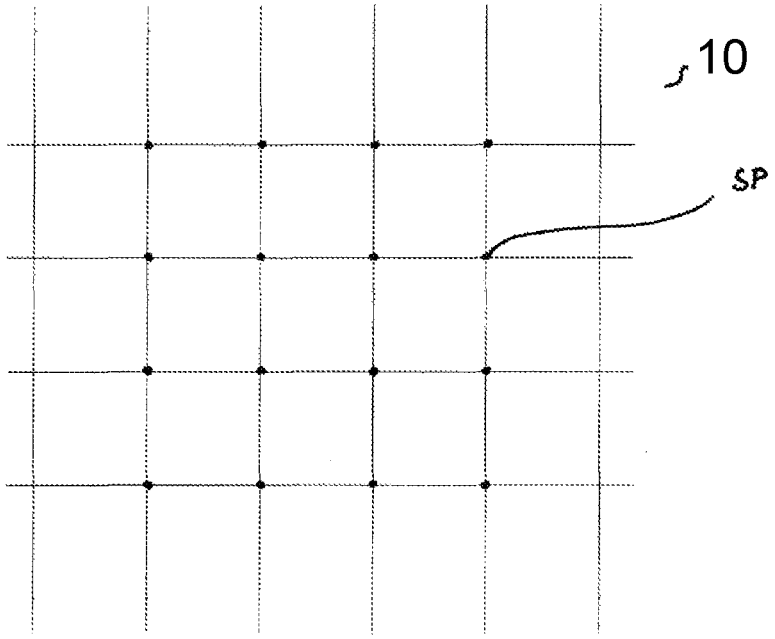
FIG. 4 shows a schematic representation of a pattern of stop points in form of an array with two four and four columns.
Figure 5:
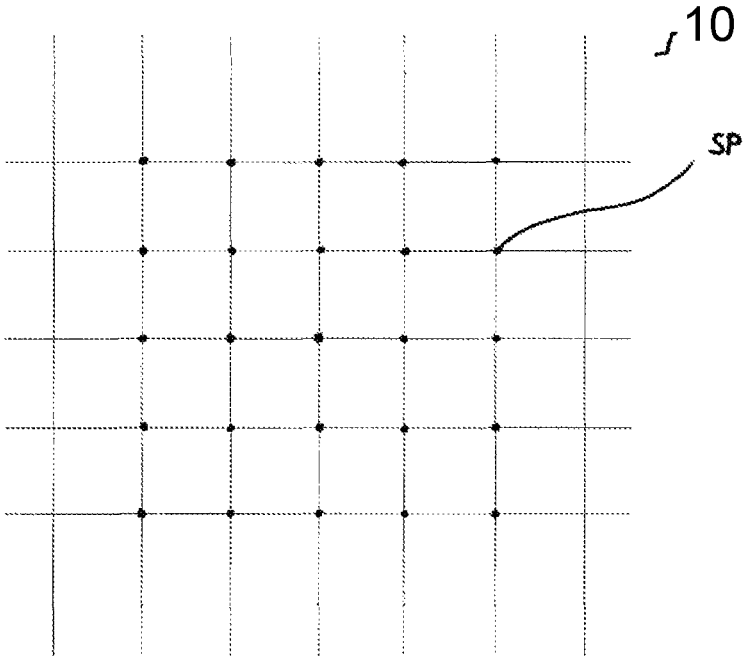
FIG. 5 shows a schematic representation of a pattern of stop points in form of an array with five rows and five columns.
Figure 6:
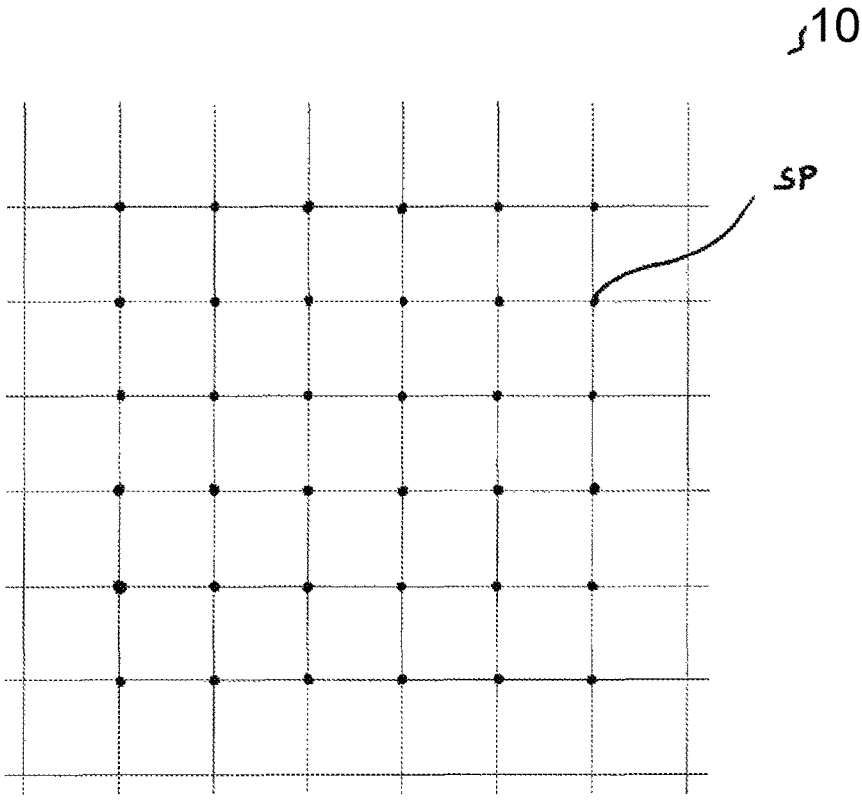
FIG. 6 shows a schematic representation of a pattern of stop points in form of an array with two six and six columns.

It is preferred to carry out the method as described above with a plurality of locally confined electrolyte streams. Then, it is preferred to treat a dedicated part of the substrate surface with one of the locally confined electrolyte streams according to the method as described above. Preferably, the dedicated parts of the substrate surface cover a great part of the substrate surface and more preferably the complete substrate surface, wherein preferably no gaps between the dedicated parts are present on the substrate surface. Preferably, the treatment of the dedicated parts of the substrate surface is carried out simultaneously with the plurality of locally confined electrolyte streams. The plurality of locally confined electrolyte streams can for example be generated by a number of nozzles which corresponds to the number of locally confined electrolyte streams. A nozzle plate is disclosed in WO 2014/095356 as a first device element which shall be included into this patent application in this respect. Preferably, a device for vertical galvanic metal, preferably copper, deposition on a substrate is disclosed, wherein the device comprises at least a first device element and a second device element, which are arranged in a vertical manner parallel to each other, wherein the first device element comprises at least a first anode element having a plurality of through-going conduits and at least a first carrier element having a plurality of through-going conduits, wherein said at least first anode element and said at least first carrier element are firmly connected to each other; and wherein the second device element comprises at least a first substrate holder which is adapted to receive at least a first substrate to be treated, wherein said at least first substrate holder is at least partially surrounding the at least first substrate to be treated along its outer frame after receiving it; and wherein the distance between the first anode element of the at least first device element and the at least first substrate holder of the second device element ranges from 2 to 15 mm; wherein the plurality of through-going conduits of the first carrier element of the first device element are going through the first carrier element in form of straight lines having an angle relating to the perpendicular on the carrier element surface between 10° and 60°.

Preferably, the arrangement of the nozzles is such that the complete substrate can be covered by locally confined electrolyte streams. Preferably, the arrangement of the nozzles has a contour that corresponds to the contour of the substrate. Preferably, a streaming velocity of the electrolyte stream at the substrate surface is increased from the middle to the border of the substrate. In order to achieve this, a lower nozzle density near the border of the substrate can be applied.

Preferably, the circumference of the first path corresponds to the form of the dedicated part of the substrate surface. It is preferred that the form of the dedicated part of the substrate is such that a surface can be completely covered by it, for example by rectangles, squares, hexagons or triangles. It is also possible to cover the substrate surface with dedicated parts of different shapes, but in a way in which the different dedicated parts together cover the surface completely. Examples for this are commonly known in mathematics or for tiled surfaces.

Preferably, the first path has a form that is different from the form of the second path. In this way, the first path can be adapted to the contour of the substrate whereas the second path can be adapted for good overlap with one or more other second paths in order to generate a good homogeneity. For example, this concerns the form and the size of the second path.

Preferably, the method is used in an electrochemical treatment apparatus. In such an electrochemical treatment apparatus, the distance between nozzles which generate the electrolyte stream and the substrate is preferably between 10 mm and 25 mm, most preferably 17.5±2.5 mm. This is a much shorter distance than in a common electrochemical treatment apparatuses. It is preferred to have many small nozzles per substrate, for example about one nozzle per 10 $cm^2$ at least in parts of the substrate or over the whole substrate. Additionally or alternatively, the distance between the nozzle and the substrate can be one third to three times the distance between two neighboring nozzles. Preferably, the nozzles have, at their ends towards the substrate, a diameter of about 1 mm. These conditions lead to a much more inhomogeneous and almost point-shaped distribution of the treatment intensity on the substrate in comparison to common electrolytic treatment with typically much higher distances between nozzles and substrate. At the hitting point of the stream from the nozzle at the substrate, the concentration of the original ingredients of the electrolyte is maximum as nothing has been used up until then, leading to different treatment conditions in comparison to other parts of the surface of the substrate which are not directly hit by the stream. Further, other treatment conditions than the ingredient concentration can cause discontinuity effects. For example, the stream velocity and/or pressure distribution of the stream from one nozzle in an almost point-shaped hitting area on the substrate surface can be inhomogeneous which leads to inhomogeneous coating thickness at this point without application of further measures. Also this effect is smoothened by the method.

A substrate can be smaller than the area that is covered by the electrolyte streams from the nozzles. Thus, a more universal method and apparatus, respectively, can be provided.

Preferably, the nozzles are directed to the substrate in an oblique manner. Preferably, electrolyte is streamed towards a typical substrate with dimensions of about 400×600 mm or about 500×500 mm with a volume flow rate of 30-40 l/min. The stream of electrolyte is preferably directed to the substrate in a horizontal flow direction. Flow speed is preferably between 20 and 35 m/s. It is preferred to use a pressure of about 800 mbar to press the electrolyte through the nozzles.

Preferably, in an apparatus which is configured to carry out the method, a substrate can be treated from two opposite sides. Then, it is sufficient to carry out one first and one second movement for the treatment of both sides of the substrate. Then, preferably, associated electrolyte streams are directed to each of the opposite sides of the substrate. The electrolyte streams have different, preferably opposite directions in order to reach the opposite sides of the substrate. Preferably, the electrolyte streams have a fixed position to each other.

Preferably, the electrolyte stream is continuous. It is preferred to use an anode with at least one through-going conduit which is used for the treatment of a substrate in a substrate holder. Preferably, a substrate holder encompasses the substrate at its circumference. It is preferred that the length of the electrolyte stream from a nozzle to the substrate surface is smaller than the greater dimension of the substrate surface, and more preferably that the length of the electrolyte stream is smaller than 1/10 of the greater dimension of the substance surface. In this way, a short distance as possible between the anode and a dedicated part of the substrate surface advantageously leads to a high precision of the position at which the treatment process takes place. This also can help to improve homogeneity of the coating thickness.

In an embodiment of the method, the second movement is carried out more than one time along the first path. In this way, the second movement is executed more often than the first movement. Thus, it is possible to define an area which is to be treated by the first movement and details of the treatment with the second movement.

In a further embodiment, the second path of a first execution of the second movement overlaps with the second path of a second execution of the second movement, wherein preferably all second paths are overlapped by at least one other second path.

An advantage of this kind of relative movement between the electrolyte stream and the substrate is that one single place on the substrate surface can be treated more than one time during the first movement, because it can be struck by different executions of the second movement. This can be true for many places on the substrate. In this way, a good homogeneity of the thickness of the coating and a good security for a complete coverage of the surface can be achieved. Preferably, many treated regions of the substrate surface, wherein said treated region comprises a plurality of treated single places, overlap with each other as a result of the fact that parts of the resulting path in a treated region cross other parts of the resulting path in the neighboring treated regions. This is preferred over treated regions which border each other without an overlap. In the latter case, there is always the risk that a gap between treated regions occurs.

Preferably, the distance covered by the first path is shorter than the distance covered by the executions of the second path along one single execution of the first path. Then, the main part of the resulting path is caused by the execution of the second movements. Preferably, a significant part of the resulting path or almost the complete resulting path is executed at single places at which different parts of the resulting path cross themselves. As the second movements are preferably executed more times than the first movement and/or are executed with a smaller distance to each other than their own size, they cross each other many times. The above mentioned measures improve the homogeneity of the thickness of the coating. Preferably, the distance, which is covered by the execution of the second movements, is at least five times longer than the distance that is covered by the first movement in one single execution of the first movement.

In a further embodiment, the first movement is non-continuous, wherein the second movement is carried out when the first movement is stopped.

Non-continuous means that along the first movement along the first path, there are times at which the first movement has a velocity and other times at which the first movement is stopped, i.e. that it does not have a velocity.

Preferably, the second movement, at times at which the second movement is not stopped, has a greater average speed than the first movement at times at which it is not stopped.

In a further embodiment, the first path comprises stop points at which the first movement is stopped and then, at the stop points, the second movement is carried out, wherein the stop points are preferably arranged in a geometrical pattern.

The pattern can be an array shaped raster, but it is also possible that the pattern has another basic geometry, for example edge points in an area covered with polygonal elements or a more complicated mosaic, for example comprising two or more different geometrical elements or it can even be an irregular basic pattern. The crucial point is to arrange the stop points at positions which render it possible to carry out second movements in a way to finally treat the surface of the substrate in a homogeneous way. Shape and size of the second movements can be adapted to the shape of the pattern and the stop points of the first movement in order to achieve this goal. It is preferred to use a pattern with regular intervals between the stop points. It is, especially in this case, preferred to always use the same second movement in all executions, but it is also possible to adapt different second movements to a special type of pattern.

Preferably, a distance between two neighboring stop points is smaller than or equal to the distance of two neighboring nozzles in the direction that links the two stop points. Then, the dedicated part of the substrate surface which is covered by the pattern fits between two nozzles such that each nozzle can treat its dedicated part of the substrate surface except a possible overlap between these dedicated parts of the substrate surface.

It is also possible to have a basic pattern which is made up of stop points for the first movement, wherein further stops are made along the path which are located between the stop points of the basic pattern. In this way, a refinement of the treatment using the method described in this patent application is possible which leads to a better homogeneity of coating thickness which is understandable by the greater amount of overlap and a more distributed treatment process and which has also been validated by experiments. An advantage of this is that the same basic pattern can be used with better results. For example, an additional stop point can be added in the middle between two stop points of the basic pattern, but it is also possible to use more than one additional stop point between two stop points of the basic pattern and/or at other positions between them.

Preferably, the first movement is carried out as a linear movement between two stop points. This is a simple and easily predictable way to carry out the first movement.

Preferably, raster points in the first movement are not reached more than one time during one single execution of the first movement. In this way, a uniform coverage of the area in which the stop points are located is achieved. By this, homogeneity is improved.

The pattern can also be used when the first movement is not stopped in order to carry out the second movement, but when the first and the second movements are carried out simultaneously. Then, the stop points of the pattern can serve as the start points for the next second movement, for example.

In a further embodiment, the geometrical pattern comprises an array with rows and columns wherein the stop points are arranged at the intersections of rows and columns, wherein preferably the number of rows is more than 2, preferably 3, 4, 5 or 6, wherein preferably the number of columns is more than 2, preferably 3, 4, 5 or 6, wherein preferably the number of columns and rows is the same such that the number of stop points is 4, 9, 16, 25 or 36, wherein the raster is a square shaped raster.

The form of the raster preferably corresponds to the form of the dedicated part of the substrate which thus can be square shaped. With such a raster type for the stop points, good results have been found by experiments. Preferably, the raster has constant distances between the stop points.

In a further embodiment, the first movement starts at a stop point which is not at the border of the pattern.

The border areas of a dedicated part of the substrate surface are more sensitive regarding inhomogeneity of the thickness of the coating because the overlap to a neighboring dedicated part does not take place by the same electrolyte stream. However, the start of the deposition process can be not yet as stable as later in the process, such that at the starting point of the deposition process is prone to cause inhomogeneities. In order to improve the homogeneity of the thickness of the coating as much as possible, it is advantageous to avoid the addition of both possible inhomogeneities from the two sources as mentioned above in this paragraph.

In a further embodiment, an outer contour of the pattern of the first movement is similar to the outer contour of the substrate surface which is to be treated.

A contour means in this context the outer borders of the substrate. Preferably, the method is used for angular, especially rectangular substrates. Then, also the pattern can be of rectangular shape. Then, the edges of a rectangular substrate are covered well by the treatment at the edges of the pattern and the corresponding second movements. The same is also true with other angular or rounded forms of the contour and the pattern, respectively.

In a further embodiment, the path of the second movement is a closed curve, preferably a circular, elliptical, rectangular or quadratic or otherwise polygonal curve, wherein, preferably, the maximum dimension of the closed curve is between 2 and 80 mm, preferably between 20 and 40 mm.

Advantageously, in a closed curve, an endpoint of a single execution can be used as the start point for the next execution. It can thus easily be repeated.

Preferably, the closed curve is carried out one time at each stop of the first movement. It is preferred that all second movements are carried out with the same speed. Also, it is preferred that all first movements are carried out with the same speed. The speed of the first movement and the speed of the second movement can also be the same.

In a further embodiment of the present invention the first movement and second movement are translation movements of the substrate essentially in the same plane. The phrase "translation movement of the substrate essentially in the same plane" in this context preferably means that the substrate is moved along the plane going through a surface of the substrate at the starting point of the first movement, wherein the corresponding surface of the moving substrate deviates less than 5 mm, more preferred less than 3 mm, even more preferred less than 1 mm, from said plane during the movement.

According to a further embodiment the path of the first movement and the path of the second movement each comprises at least an essentially straight line or a curve, wherein said curve is closed and selected from circular or elliptical curves, and wherein the essentially straight line provides a length of at least 5 mm, like 5 mm, more preferred at least 1 cm, like 1 cm, even more preferred at least 3 cm, like 3 cm. The phrase "essentially straight line" in this context refers to a line deviating less than 10%, more preferred less than 7%, even more preferred less than 5%, from a virtual straight line. Such percentage is calculated based on the highest distance between said line and the virtual straight line in relation to the length of said essential straight line, wherein the virtual straight line is arranged to provide such highest distance being as low as possible. Naturally, such distance between the essentially straight line and the virtual straight line is measured perpendicular to the virtual straight line.

In further embodiments, the path of the first movement between at least one, more preferred at least two, even more preferred at least three, most preferred at least four, stop point pair(s) consists of an essentially straight line. The phrase "stop point pairs" in this context refers to two subsequent stops points of the first movement.

According to further embodiments the path of the first movement between two subsequent points comprises, preferably consists, of an essentially straight line and the path of the second movement comprises, preferably consists, of a spiral, circular or elliptical curve, more preferred a circular or elliptical curve, even more preferred a circular curve.

In a further embodiment, after having carried out all first and second movements, the relative position of the nozzles and the substrate is the same as at the beginning of the first and second movements or a neighboring relative position.

An advantage of this feature is that the process of carrying out the first and the second movements can be repeated in the same way and at the same place on the substrate surface. Preferably, more than one cycle of execution of the first and the second movements is carried out on the same place on the substrate surface.

In a further embodiment, the first and the second movements are carried out by starting at the beginning of a predetermined time period, wherein a last movement ends with the end of the predetermined time, wherein the execution of first and second movements is repeated and ended at the end of the execution of all first and second movements along the first path, when time period has expired.

It is also possible to end a plating cycle at symmetrical points in which not all stop points along the first path have been reached yet, but the stop points which have been reached by the process are distributed in a regular way over the pattern which are preferably symmetrical to an end symmetry point. As the stop points which have been reached by the process correlate with regions that have been treated, it is preferred to start at stop point that is a start symmetry point from which the process can be ended at an end symmetry point such that the treated regions are symmetrical to the end symmetry point. Preferably, the start symmetry point and the end symmetry point are the same or neighboring stop points.

In order to carry out the deposition process in a fixed time period, it is alternatively also possible to adapt the speed of the first and/or second movement. Then, preferably, the speeds are calculated before the execution of the cycle starts. A typical time period during which the movements are carried out can be about 300 seconds.

In a further embodiment, the first and the second movements start at a point on the substrate to which the areas on the substrate which are to be treated are symmetrical to this start symmetry point. Starting from such a start symmetry point facilitates the possibility to uniformly cover the whole substrate surfers.

The movements can end at an end symmetry point to which the areas of the subject which already have been treated are symmetrical. Then, the treatment is ended in a state, at which the produce coating is particularly homogeneous.

In a further embodiment, the method is carried out using a substrate holder reception apparatus for clamping a substrate holder in a substrate holder clamping direction in a predetermined position of the substrate holder and releasing the substrate holder, comprising at least one substrate holder connection device for mechanical aligning and electrically contacting of the substrate holder, wherein the substrate holder connection device comprises a separate substrate holder alignment device for aligning the substrate holder with the substrate holder connection device in an alignment direction, and a separate substrate holder contact device for electrically contacting the substrate holder.

In a further aspect of the invention, a substrate holder reception apparatus for clamping a substrate holder in a substrate holder clamping direction in a predetermined position of the substrate holder and releasing the substrate holder is proposed, which comprises at least one substrate holder connection device for mechanical aligning and electrically contacting of the substrate holder, wherein the substrate holder connection device comprises a separate substrate holder alignment device for aligning the substrate holder with the substrate holder connection device in an alignment direction, and a separate substrate holder contact device for electrically contacting the substrate holder, characterized in that the apparatus is used and/or configured to carry out one of the methods according to one of the preceding claims.

Such a substrate holder reception apparatus is particularly suitable for carrying out the method as described above. Because of the small distance between the nozzles and the substrate which has been proposed above, it is preferred to have a precise reception apparatus in order to minimize inhomogeneity which could occur by tolerances in a reception position or shaky fixation of the substrate.

In a further aspect of the invention, an electrochemical treatment apparatus for treating a substrate which acts as a cathode in an electrolyte fluid it is proposed, wherein the electrochemical treatment apparatus comprises an anode and a substrate holder reception apparatus as set out above, wherein an active surface of the anode, in operation, is directed to the substrate, wherein the anode has a distance to the substrate of less than 25 mm and preferably less than 17.5 mm.

Such an electrochemical treatment apparatus has the advantage that by the small distance between the substrate and the anode, very effective and fast treatment can be achieved.

A substrate holder reception apparatus as mentioned above has been described in a former European patent application No. EP 15179883.2 of the same applicant. This application shall be integrated into the present patent application in respect of the substrate holder reception apparatus and an electrochemical treatment apparatus.

Several experiments have been carried out with the method according to the invention. Results are presented in the following Table on the following pages. The key result is indicated in the column named NU (non-uniformity) having percentage as unit, wherein NU is defined as:

$$\left(\frac{(\text{Maximum}-\text{Minimum})\text{thickness of metal deposition}}{2\times\text{average thickness of metal deposition}}\right)\times 100$$

For all experiments, the same setup of the plating apparatus has been used. Only adjustable parameters have been changed. The experiments have been made with an apparatus which is capable to plate two sides of the same substrate, wherein the sides are denominated sides A and B. The number of points (pt) means the number of stop points in the first path.

Pitch means the distance between stops of the first movement which corresponds to shifting of the position of the second movement. If two pitches are indicated, the experiment has been carried out twice using the different pitches and leading to different NU results.

TABLE

Experiments according to the inventive method and one comparative example according to known prior art.

| Run No. | Side | NU [%] | Remarks |
|---|---|---|---|
| First Group Experiments | | | Conducted by Pulse Plating (PP) with first set of pulses |
| 222 | A | 19.2 | Second path circle with a radius of 5 mm without first path (Prior Art) |
| 223 | A | 14.3 | Second path circle with a radius of 5 mm; Center of second path shifted every 10 s; Pitch 1.875 mm; Square pattern of 9 stop points |
| 224 | A | 8.9 | Second path circle with a radius of 5 mm; Center of second path shifted every 10 s; Pitch 3.75 mm; Square pattern of 9 stop points |
| 225 | A | 11.5 | Second path circle with a radius of 5 mm; Center of second path shifted every 10 s; Pitch 1.875 mm; Square pattern of 25 stop points |
| Second Group Experiments | | | Conducted by Direct Current (DC) Plating |
| 242 | B | 6.5 | Second path circle with a radius of 5 mm; Center of second path shifted every 10 s; Pitch 3.75 mm; Square pattern of 9 stop points |
| 244 | A | 6.4 | Second path circle with a radius of 5 mm; Center of second path shifted every 10 s; Pitch 3.75 mm; Square pattern of 9 stop points |
| Third Group Experiments | | | Conducted by Pulse Plating (PP) with second set of pulses |
| 248 | A | 51.2 | Second path circle with a radius of 5 mm without first path (Prior Art) |
| 249 | A | 8.1 | Second path circle with a radius of 5 mm; Center of second path shifted every 10 s; Pitch 2.5 mm, Square pattern of 16 stop points |

TABLE-continued

| Experiments according to the inventive method and one comparative example according to known prior art. | | | |
|---|---|---|---|
| Run No. | Side | NU [%] | Remarks |
| 250 | A | 21.1 | Second path circle with a radius of 5 mm; Center of second path shifted every 10 s; Pitch 3.75 mm; Square pattern of 9 stop points |
| 252 | B | 8.6 | Second path circle with a radius of 5 mm; Center of second path shifted every 10 s; Pitch 2.5 mm; Square pattern of 16 stop points |
| 254 | A | 9.5 | Second path circle with a radius of 5 mm; Center of second path shifted every 10 s; Pitch 2.5 mm; Square pattern of 16 stop points |
| 256 | A | 4.7 | Second path circle with a radius of 5 mm; Center of second path shifted every 10 s; Pitch 2.5 mm; Square pattern of 25 stop points |
| 267 | B | 8.3 | Second path circle with a radius of 5 mm; Center of second path shifted every 10 s; Pitch 5 mm; Square pattern of 9 stop points |

FIG. 1 shows a schematic representation of a resulting path 12 which results of adding a first path 1 of first movement and a second path 2 of a second movement. The first movement is carried out along a first path 1 which is depicted with dotted lines. The first path 1 runs across nine stop points SP1 to SP9 1 during an execution of it. The stop points SP 1 to SP9 are crossed by the first path in the order of their numbers. Thus, a pattern 10 for the first movement is made up by the stop points SP1 to SP9. In FIG. 1, the stop points SP1 to SP9 are arranged in three rows and three columns. The execution of the first path 1 starts at stop point SP1. Stop point SP1 is arranged in the middle of the other stop points SP2 to SP9. Then, the first path 1 proceeds to stop points SP2 to SP9 which are arranged at circumference of the pattern 10. It is also possible to start from stop point SP1, then to continue to stop points SP9, SP8, SP7 and so on in this order until SP2 is reached. As a final step, and the path returns to stop point SP1 again, such that a closed loop is established for the first path 1. All stop points SP1 to SP9 have the same distance to their neighbors in direction of a column or a row. By the first path 1, the stop points SP1 to SP9 are connected by straight path sections.

At each stop point SP1 to SP9, the first movement is stopped. The movement is then continued with one of the second paths 2 which is associated to the specific stop point SP1 to SP9. Each of the stop points SP1 to SP9 is associated with one second path 2. All nine second paths 2, which not all are indicated by an own reference sign, have the same form, namely the form of a circle, and the same size. Each of the second paths 2 overlaps with its neighbors and also with its second neighbors. The radius of a second path 2 is bigger than her distance between two neighboring stop points SP1 to SP9 in direction of column or a row.

The resulting path 12 thus proceeds through straight sections of the first path 1 in turn with circles of the second path 2. An execution of the resulting path 12 can be repeated for further treatment of the substrate in an arbitrary number of times.

FIGS. 2 to 6 show further possible patterns 10 of stop points SP which can be used in different first paths which are not shown in FIGS. 2 to 6. The patterns have a quadratic contour. The stop points are arranged at the intersections of column and row lines. The columns and rows shall be defined at the lines and not as their intermediate spaces. There are many possibilities to define a first path through the stop points SP, wherein each stop point SP is reached by the first path. FIGS. 2 to 6 differ by the number of columns and rows of the stop points SP. The lines without stop point show a basic grid in which the array of stop points SP and accordingly their columns and rows are arranged.

Figure 7:
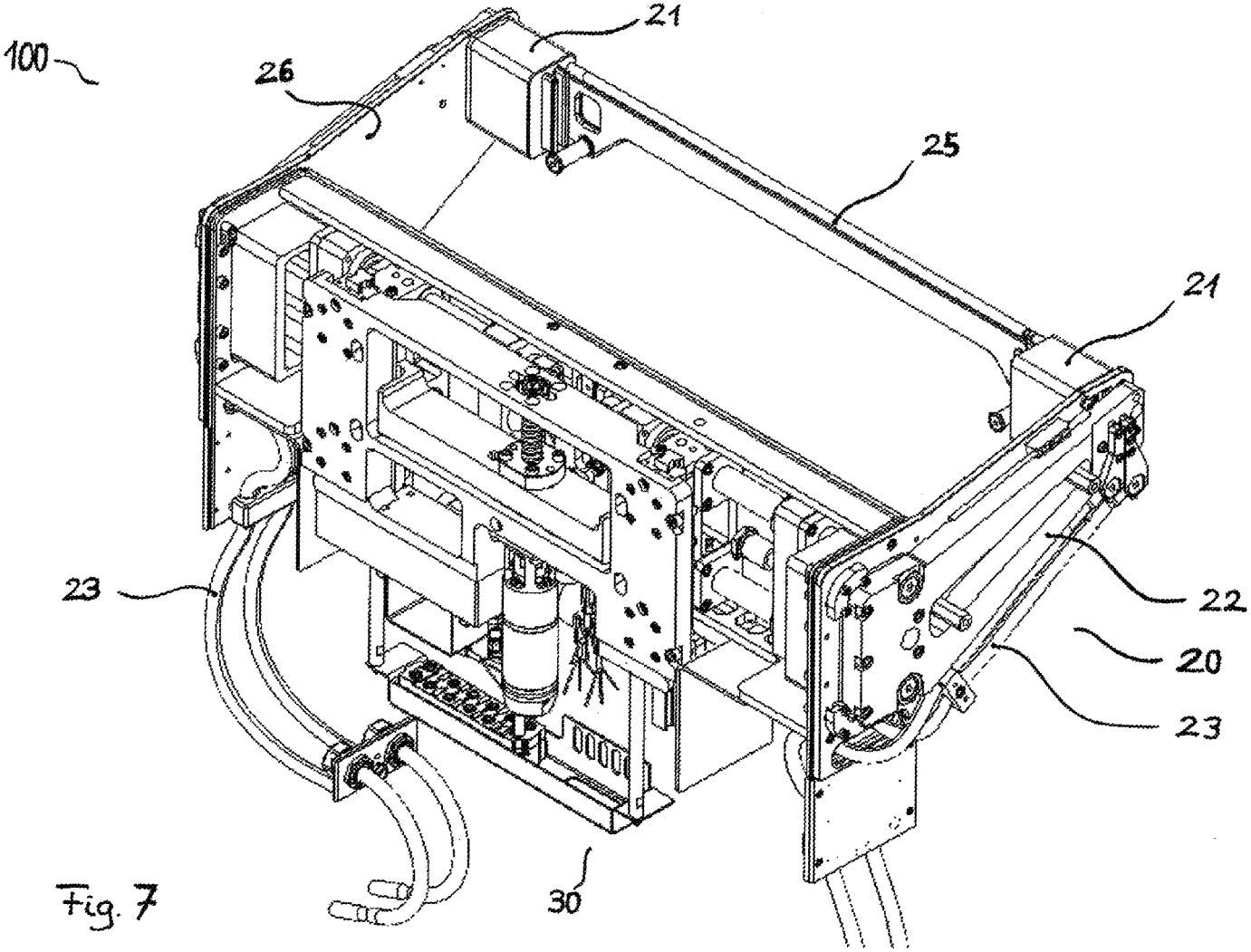
FIG. 7 shows a substrate holder reception apparatus of an apparatus for galvanic treatment of a flat material.

FIG. 7 shows a substrate holder reception apparatus 100 of an apparatus for a wet-chemical or electrochemical treatment of a flat material. The substrate reception apparatus 100 comprises a substrate holder clamping device 20 that is configured to receive a substrate holder which is not shown in FIG. 7, and a substrate holder movement device. The substrate reception apparatus 100 is configured to receive substrate holder between two substrate holder connection devices 21. To the substrate holder, a substrate is attachable. The substrate comprises the substrate surface which is to be treated by methods according to this invention. The substrate holder is configured to supply electric current to the substrate, wherein the substrate acts as a cathode in the treatment process.

The substrate movement device 30 can be fixed directly or indirectly to a machine base which is not shown in FIG. 7. Also, an anode can be fixed to the machine base or is mechanically connected to the substrate reception apparatus 100 in another way. The substrate movement device is configured to move the substrate relatively to the anode which is not shown in FIG. 7, in a direction parallel to an anode surface. The anode surface is preferably even and is, during treatment, directed to the substrate. A treated surface of the substrate is aligned substantially parallel to the anode surface during treatment. In order to connect the substrate holder to the substrate reception apparatus 100, the substrate holder clamping device 20 comprises two substrate holder connection devices 21 between which the substrate holder can be arranged. The substrate holder connection devices 21 each are arranged at the end of a substrate holder clamping arm 22. The substrate holder connection devices 21 also each are supported by a protruding part of a clamping device frame 26 each of which is parallel one of the arms 22. Each of the substrate holder connection devices 21 can in operation be supplied with electric current by current supply cables 23. The current supply cables 23 to each substrate holder connection devices 21 supply the same electrical potential to their substrate holder connection device 21. Between the substrate holder connection devices 21, a frame bridge 25 is arranged. The substrate holder connection device 21, in turn, comprises a substrate holder alignment device which is configured to align a substrate holder relatively to the substrate holder clamping device 21. The substrate holder alignment device and the substrate reception apparatus 100 as well as the relative mechanical connection pathway between the substrate holder reception apparatus 100 and the anode are configured to align a treated surface of a substrate substantially parallel to the flat anode surface. Further, the substrate holder clamping device 21 comprises a substrate holder contact device which is configured to supply current to the substrate holder. The current flows to the substrate via the substrate holder.

Figure 8:
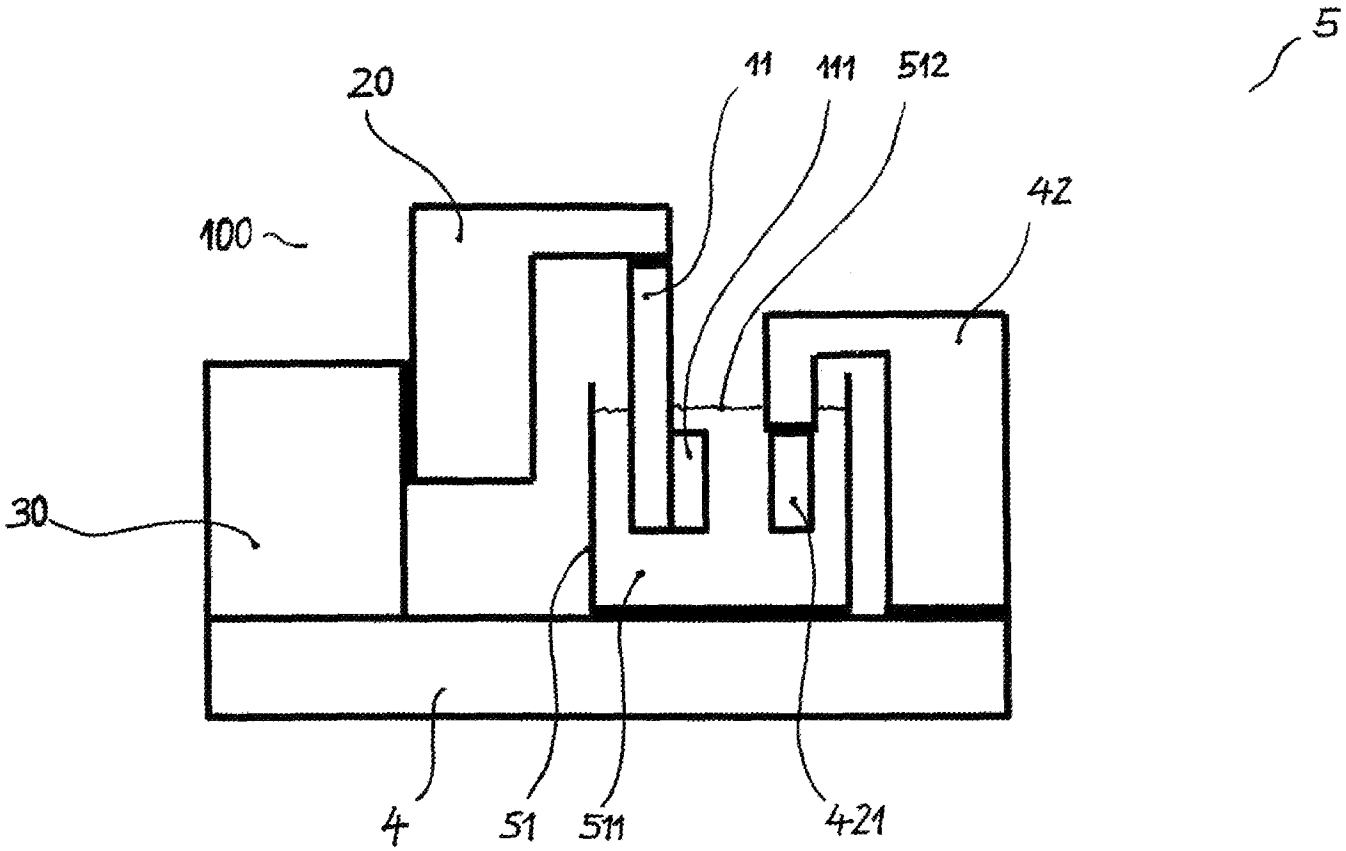
FIG. 8 shows schematically a view of an electrochemical treatment apparatus.

FIG. 8 shows schematically a view of an electrochemical treatment apparatus 5 comprising a machine frame 4 with an anode holder 42 which is holding an anode 421. Further, machine frame 4 a substrate holder reception apparatus 100, which comprises a substrate holder clamping device and a substrate holder movement device 30. The substrate holder clamping device 20 clamps a substrate holder 11 which in turn holds a substrate 111. The substrate 111 and the anode 421 are immersed in an electrolyte 511 accumulated up to an electrolyte level 512 which is contained in an electrolyte basin 51. In this way, electric current can flow from the anode 421 to the substrate 111 in order to treat the substrate 111. Particularly, the substrate 111 is galvanized.

Figure 9A:
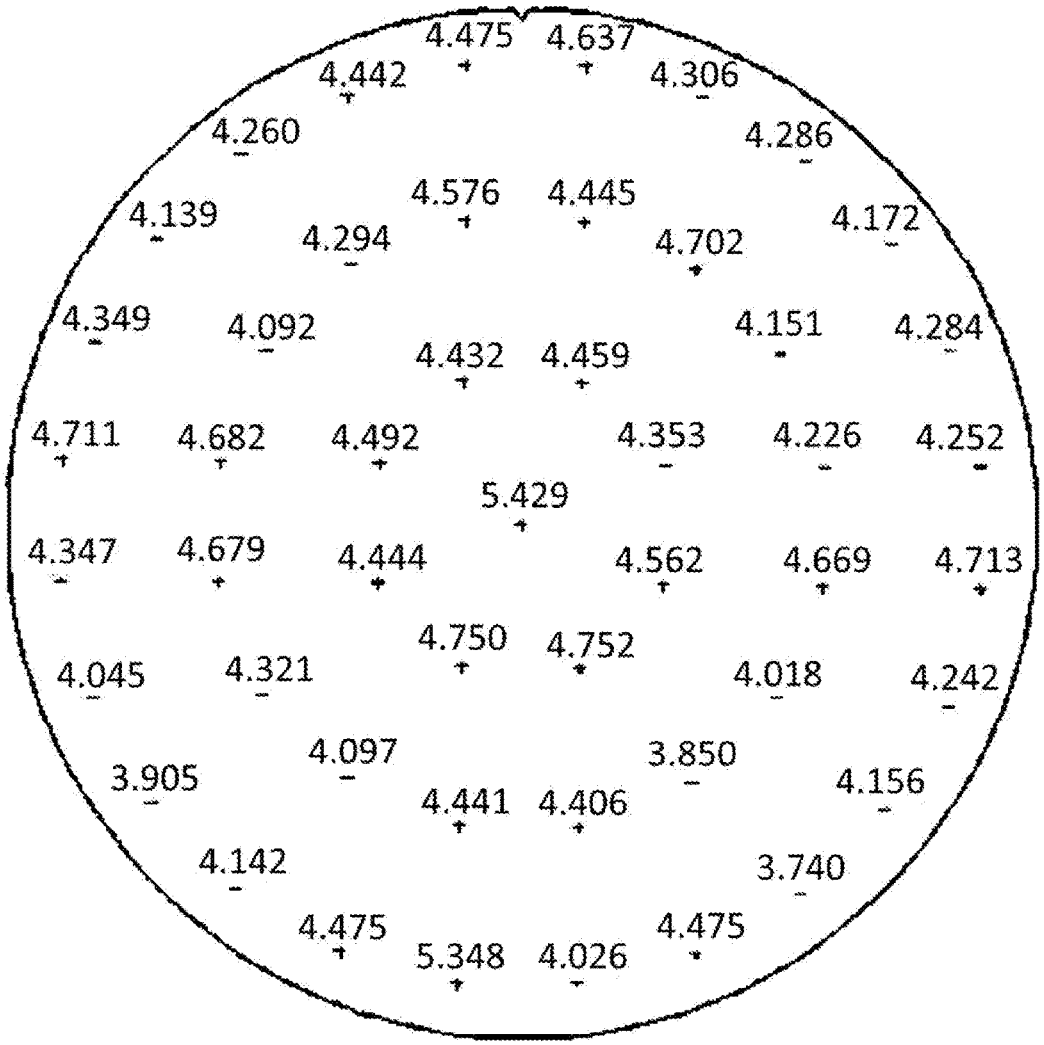
FIG. 9A shows results of an experiment with a method according to the state of the art, wherein thicknesses of the deposited coating are shown across a substrate.
Figure 9B:
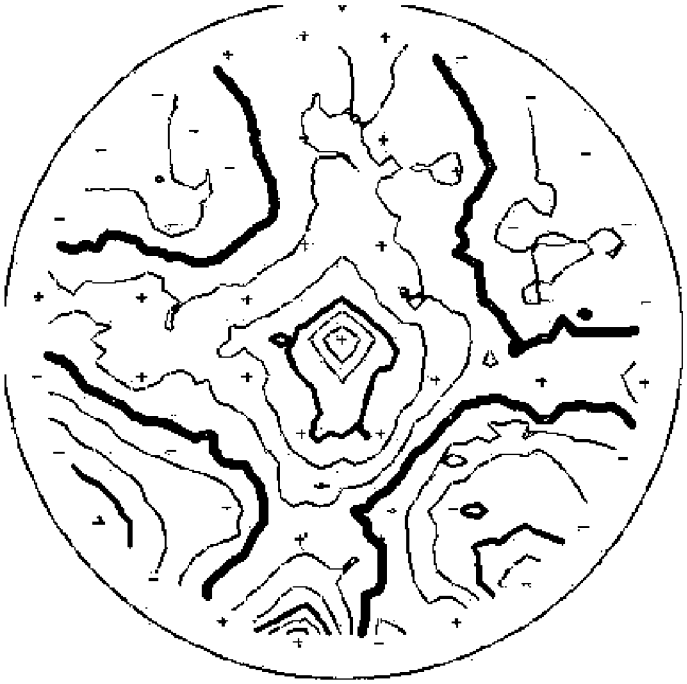
FIG. 9B shows the same results as FIG. 9A, but in a contour line representation.

FIGS. 9A and 9B show the measurement result of the thickness of a metal coating of a galvanically metal plated substrate which has been indicated as experiment 222 in the Table above (Comparative Example). In FIG. 9A, measurement results are displayed as numbers, whereas in FIG. 9B, the thickest lines represent the average thickness. Other thinner lines marked by small "+" or "−" represent deviations from the average thickness of the metal deposition on the substrate, wherein the higher the deviation is the thicker the respective lines are depicted. Thus, the more relatively thick lines are able to detect on such a picture, the more irregular is the metal thickness distribution deposited on the substrate surface. The thickness of the coating has been measured at 49 points on the related substrate surface. Here, a simple circle has been used as the first path according to the state-of-the-art. Second paths have not been executed. The substrate has a circular circumference.

As a result, a non-uniformity of 19.2 has been measured. The average thickness distribution line has the form of ridges and valleys with a star-shape with four rays emerging from the middle of the substrate. Other lines are clearly to detect leading to the conclusion that this is a quite non-regular pattern.

Figure 10A:
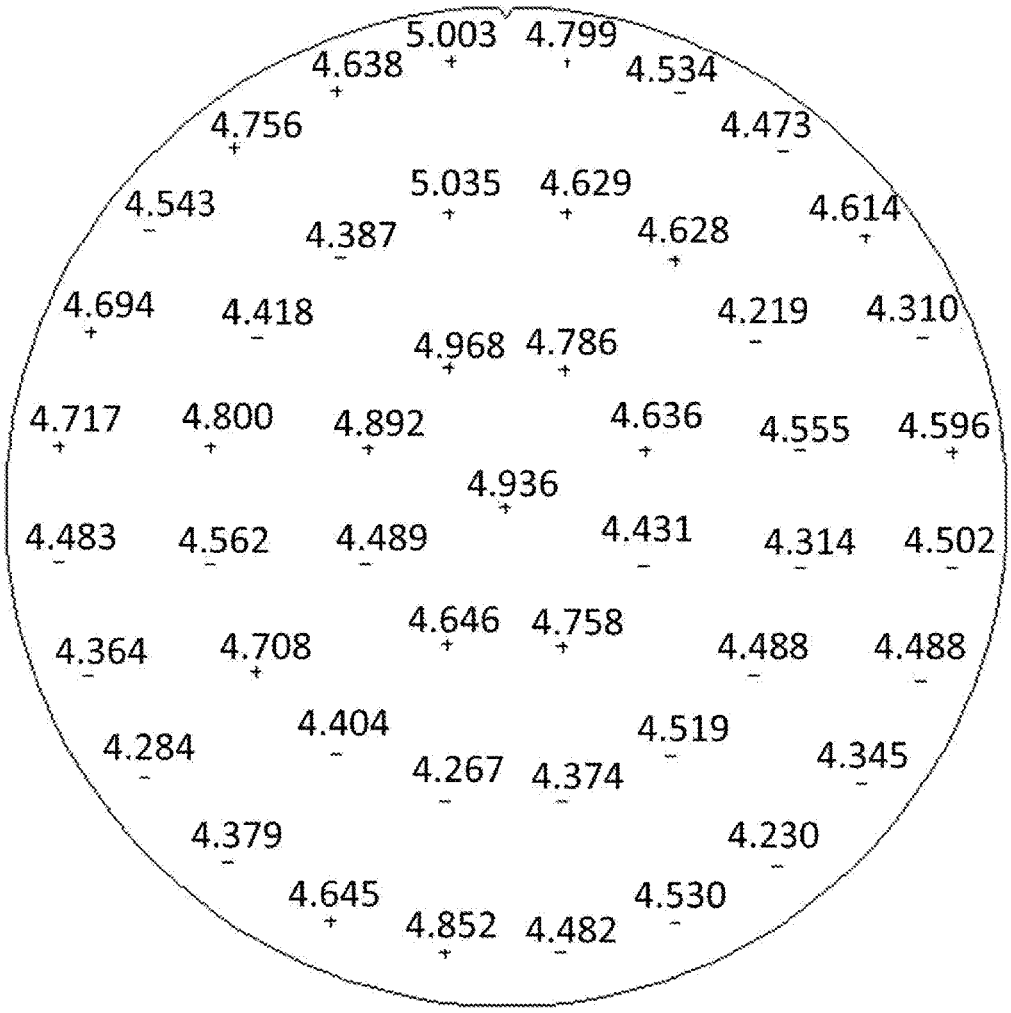
FIG. 10A shows results of an experiment with a method according to the invention, wherein thicknesses of the deposited coating are shown across a substrate.
Figure 10B:
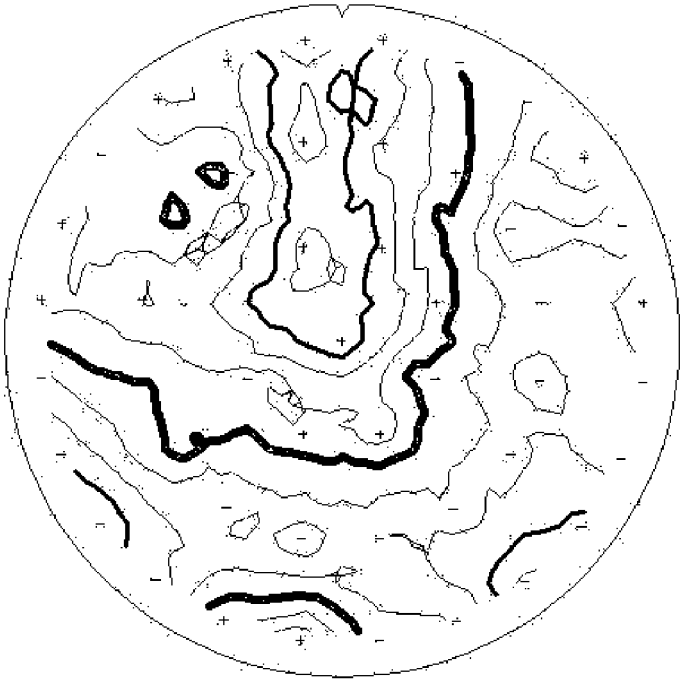
FIG. 10B shows the same results as FIG. 10A, but in a contour line representation.

FIGS. 10A and 10B show the measurement result of the thickness of a metal coating of a galvanically metal plated substrate which has been indicated as experiment 224 in the Table above (Inventive Example). In FIG. 10A, measurement results are displayed as numbers, whereas in FIG. 10B, the thickest lines represent the average thickness. Other thinner lines marked by small "+" or "−" represent deviations from the average thickness of the metal deposition on the substrate, wherein the higher the deviation is the thicker the respective lines are depicted. The thickness of the coating has been measured at 49 points on the related substrate surface. Here, a first path through a pattern of stop points has been used according to the invention. Second paths have been executed as circles. The substrate also has the circular circumference.

As a result, a non-uniformity of 8.9 has been measured. The average thickness distribution line mainly has the form of a slight slope. Other lines are much thinner leading to the conclusion that this is a much more regular pattern in comparison to FIGS. 9A and 9B.

REFERENCE SIGNS

1 First path
2 Second path
4 Machine frame
5 Electrochemical treatment apparatus
10 Pattern
11 Substrate holder
12 resulting path
20 Substrate holder clamping device
21 Substrate holder connection device
22 Arm
23 Cable
25 Frame bridge
26 Clamping device frame
30 Substrate movement device
42 Anode holder
51 Electrolyte basin
100 Substrate holder reception apparatus
111 Substrate
421 Anode
511 Electrolyte
512 Electrolyte level
SP, SP1 to SP9 Stop points

The invention claimed is:

1. Method for galvanic metal deposition of a substrate using an anode and an electrolyte, wherein from each of a plurality of electrolyte nozzles a locally confined electrolyte stream is directed towards a part of a substrate surface which is to be treated, wherein a relative movement is carried out between the substrate and the electrolyte stream during deposition, wherein a first movement is carried out along a first path, wherein at least along a part of the first path a second movement is carried out along a second path, and wherein the first and the second movement each are relative movements between the electrolyte stream and the substrate, wherein the first movement is non-continuous, wherein the second movement is carried out when the first movement is stopped, wherein the first path comprises stop points (SP, SP1 to SP9) at which the first movement is stopped and then, at the stop points (SP, SP1 to SP9), the second movement is carried out, wherein the stop points (SP, SP1 to SP9) are arranged in a geometrical pattern, and wherein the stop points (SP, SP1 to SP9) are arranged in rows and columns, such that the geometrical pattern is an array with rows and columns.

2. Method according to claim 1, characterized in that a second movement is carried out more than one time along the first path.

3. Method according to claim 2, characterized in that the second path of a first execution of the second movement overlaps with the second path of a second execution of the second movement, wherein all second paths are overlapped by at least one other second path.

4. Method according to claim 1, wherein the array with rows and columns comprises a number of rows more than 2, a number of columns more than 2.

5. Method according to claim 4 wherein the number of rows is from 3 to 6 and the number of columns is from 3 to 6.

6. Method according to claim 4 wherein the number of columns and rows is the same such that the number of stop points is 4, 9, 16, 25 or 36.

7. Method according to claim 1, characterized in that the first movement starts at a stop point (SP1) which is not at a border of the pattern.

8. Method according to claim 1, characterized in that an outer contour of the pattern of the first movement is similar to an outer contour of the substrate surface which is to be treated.

9. Method according to claim 1, characterized in that the second path of the second movement is a closed curve, wherein a maximum dimension of the closed curve is between 2 and 80 mm.

10. Method according to claim 9 wherein the closed curve is a circular, elliptical, rectangular or quadratic or otherwise polygonal curve.

11. Method according to claim 1, characterized in that after having carried out all first and second movements, a relative end position of the electrolyte stream and the substrate is the same as the relative beginning position of the first and second movements or the relative end position is a neighboring position to the relative beginning position.

12. Method according to claim 1, characterized in that the first and the second movements are carried out by starting at the beginning of a predetermined time period, wherein a last movement ends with the end of the predetermined time, wherein the execution of first and second movements is repeated and ended at the end of the execution of all first and second movements along the first path, when time period has expired.

13. Method according to claim 1, characterized in that the first path has a form that is different from the form of the second path.

14. Method according to claim 1, characterized in that the method is carried out using a substrate holder reception apparatus for clamping a substrate holder in a substrate holder clamping direction (SHCD) in a predetermined position of the substrate holder and releasing the substrate holder, comprising at least one substrate holder connection device for mechanical aligning and electrically contacting of the substrate holder, wherein the substrate holder connection device comprises a separate substrate holder alignment device for aligning the substrate holder with the substrate holder connection device in an alignment direction, and a separate substrate holder contact device for electrically contacting the substrate holder.

* * * * *